US005879032A

United States Patent [19]

Asanuma

[11] Patent Number: 5,879,032

[45] Date of Patent: Mar. 9, 1999

[54] FLEXIBLE JOINT FOR A CULVERT

[75] Inventor: Yoshinori Asanuma, Tokyo, Japan

[73] Assignee: Seibu Polymer Kasei Kabushiki Kaisha, Japan

[21] Appl. No.: 855,926

[22] Filed: May 14, 1997

Related U.S. Application Data

[62] Division of Ser. No. 563,948, Nov. 29, 1995, Pat. No. 5,704,657.

[30] Foreign Application Priority Data

Dec. 12, 1994 [JP] Japan ..... 6-332048

[51] Int. Cl.[6] ..... F16L 51/02; F21D 11/15

[52] U.S. Cl. ..... 285/224; 285/300; 285/266

[58] Field of Search ..... 285/224, 300, 285/301, 227, 226, 47

[56] References Cited

U.S. PATENT DOCUMENTS

| | | | |
|---|---|---|---|
| 3,460,856 | 8/1969 | Van Tine et al. | 285/300 |
| 3,997,194 | 12/1976 | Eifer et al. | 285/300 |
| 4,848,803 | 7/1989 | Bachmann | 285/224 |
| 4,885,703 | 12/1989 | Deering | 285/300 |
| 5,011,194 | 4/1991 | Nitta | 285/224 |
| 5,472,295 | 12/1995 | Ikeda | 405/152 |
| 5,653,474 | 8/1997 | Ninacs | 285/301 |

FOREIGN PATENT DOCUMENTS

| | | | |
|---|---|---|---|
| 595664 | 11/1993 | European Pat. Off. . | |
| 2348756 | 4/1975 | Germany . | |
| 2427369 | 8/1975 | Germany . | |
| 3441738 | 2/1986 | Germany . | |
| 2052665 | 1/1981 | United Kingdom | 285/300 |

*Primary Examiner*—Eric K. Nicholson
*Attorney, Agent, or Firm*—Hedman, Gibson & Costigan, P.C.

[57] ABSTRACT

A flexible joint for a culvert includes a pair of annular connecting members, a flexible sealing member fixed to the connecting members, bearing means provided radially inwardly of the flexible sealing member and fixed to the connecting members for supporting the flexible sealing member to prevent inward deformation of the flexible sealing member. The bearing means may consist of bearing bars arranged circumferentially or may consist of a pair of annular support members. The flexible joint further includes cylinders fitted loosely on the bearing bars. The flexible joint may further include an annular joint filling member provided between the connecting members for preventing flowing of secondary lining concrete into space between the connecting members and having a thickness in the radial direction which enables continuous depositing of the concrete from one culvert unit to another culvert unit to be joined together.

2 Claims, 8 Drawing Sheets

PRIOR ART

FLEXIBLE JOINT FOR A CULVERT

This is a divisional of application Ser. No. 08/563,948, filed Nov. 29, 1995 now U.S. Pat. No. 5,704,657.

BACKGROUND OF THE INVENTION

This invention relates to a flexible joint used for joining constituent units of culverts or covered conduits such as waterworks, gully drains, subways and tunnels.

Known in the art is a flexible joint for a culvert as shown in FIG. 10. This prior art flexible joint includes a pair of annular connecting members b, b' which are fixed to opposed end surfaces of two adjacnet culvert units a, a' to be connected together. These connecting members b, b' have inner annular walls b1, b1' and outer annular walls b2, b2' and space is defined between these annular walls b1 and b2, and b1' and b2'. A plurality of bearing bars c disposed circumferentially at a predetermined interval have their end portions received in the spaces in the connecting members b, b' in a manner to be slidable in the axial direction of the culvert within a certain limited range in the spaces of the connecting members b, b' and yet to be prevented from disengaging from the connecting members b, b'. There are provided a first outer flexible sealing member d and a second outer flexible sealing member e of a generally short cylindrical configuration with undulating surfaces which are made of rubber or a synthetic resin and are disposed radially outwardly of the circumferentially arranged bearing bars c and have thier end portions fixed to the inner annular walls b1, b1' of the connecting members b, b'. There is also provided an inner flexible sealing member f of a generally short cylindrical configuration having undulating surfaces which is disposed radially inwardly of the bearing bars c and has thier end portions fixed to the inner annular walls b1, b1' of the connecting members b, b'. The inner annular walls b1, b1' of the connecting members b, b' thus are hermetically connected to each other by the flexible sealing members d, e and f.

In constructing a culvert by a shield driving method, a primary lining is constructed by connecting segments g, g' one after another and a secondry lining is constructed by moving a slide form machine stepwisely by a predetermined distance to deposit raw concrete under a high pressure to the peripheral surface of the completed first covering. For constructing a frame of the flexible joint which enables depositing of raw concrete in the secondary lining, annular frame plates h, h' for the secondary lining are fixed to the radially inner end portions of the annular inner walls b1, b1' of the connecting members b, b'. Further, annular anchor receiving plates i, i' are fixed to the radially inner end portions of these frame plates h, h'. Hook portions of a plurality of anchor members j, j' arranged circumferentially are hooked in holes formed in the anchor receiving plates i, i' and the other end of the anchor members j, j' are spot-welded to the radially inner end portions of the outer annular walls b2, b2' of the connecting members b, b'. The annular frame plates h, h' are divided in plural portions in the circumferential direction and adjacent ones of these portions are connected to each other by means of bolts screwed to joint plates k, k.

In the above described process, raw concrete is deposited by the slide form machine up to points blocked by the frame plates h, h' to perform the second covering work. In FIG. 10, reference character m designates a inside cover made of rubber provided for providing an inside peripheral portion of the flexible joint which is flush with the inner peripheral surface of the other portions of the culvert units a, a' and also for preventing intrusion of dust into the space between the frame plates h, h'. Reference character n desigantes a skin plate provided for preventing intrusion of dust into the space abvove the first flexible sealing member d.

In this type of flexible joint for a culvert, if there is a relatively large gap between respective adjacent bearing members c which are arranged circumferentially, there will arise a case where, when water is caused to leak into the space outside of the second flexible sealing member e, the second flexible sealing member e is deformed by pressure applied by the leaking water to project radially inwardly into the gap between the bearing bars c. This projecting portion of the second flexible sealing member e which is located between the adjacent bearing bars c tends to be clamped by these bearing bars c and thereby damaged when the culverts a, a' move toward each other due to a change in the underground environment such as earthquake. For preventing such damage, the bearing bars c have been arranged in such a manner that the gap between respective adjacnet bearing bars c is made as small as possible or even nil. Such arrangement of the bearing bars c, however, requires a large number of the bearing bars c which results in excessive strength of the bearing bars c which is quite unnecessary for supporting the second flexible sealing member e and increase in the total weight of the bearing bars C. Thus, difficulty arises in assembling the flexible joint and the manufacturing cost of the flexible joint also increases.

Further, in this type of prior art flexible joint, there may arise a case where, after use of the flexible joint for many years, the space between the inner annular walls b1, b1' of the connecting members b, b' radially outwardly of the second flexible sealing member 2*e* is filled with leaking water. In this case, the flexible sealing member e is supported by the bearing bars c against pressure of the leaking water and this state will continue so long as the joint maintains the initial state of installation. When the culvert units a, a' move toward each other due to an earthquake in this state, no problem will arise if water flows out through the gap of the skin plate n which is spot-welded at one end thereof only to either of the connecting members b, b'. When, however, water does not flow out of the inside space of the joint for the reason that the earth outside of the joint has only a small coefficient of water permeability or that the outside of the joint is filled with concrete, water filled in the space between the connecting members b, b' is compressed and water pressure increases sharply. This causes the bearing bars c to be pressed through the flexible sealing member e with the result that the flexible sealing member e and the bearing bars c will be deformed and ultimately damaged.

Furthermore, in the prior art flexible joint shown in FIG. 10, the frame including the frame plates h, h' is constructed for depositing concrete for the secondary lining as described above. This frame projects from the primary lining ( segments g, g') into the culvert space by a large measure and this prevents an easy shift of the slide form machine. Besides, since the standard distance of movement for a single operation of the slide form machine is 9 m, in a case where the flexible joint is located in a middle position within this distance of movement, the operation for depositing concrete is stopped halfway at the location of the frame plate (e.g., frame plate h) before reaching the standard distance and then the slide form machine is carried to the other side of the flexible joint and the operation for depositing concrete is resumed to deposite concrete to the location of the other frame plate (e.g., frame plate h'). Thus, in this case, the operation for depositing concrete cannot be made in a single operation but it must be performed in two separate operations and this decreases the efficiency of the secondary lining.

The secondary lining is performed by depositing concrete by a predetermined thickness in the radial direction measured from the wall surface of the culvert formed by the shield driving. In the priro art flexible joint shown in FIG. 10, allowance of variation in this thickness in the radial direction in the flexible joint section caused by irregularity in the digging work is an extremely small value of D1. Therefore, when the flexible joint has fallen inwardly beyond the value D1 due to irregularity caused during the digging work, the slide form machine abuts against the inner end portion of the frame and thereby is prevented from further executing the planned secondary lining. Accordingly, a very high accuracy in the shield driving work is required for maintaining this small allowance of variation D1.

It is, therefore, a first object of the present invention to provide a flexible joint for a culvert which is light in weight, easy to handle and of a low manufacturing cost.

It is a second object of the invention to provide a flexible joint for a culvert which, when the joint is subjected to an abrupt deformation due to an earthquake or other reason in a state where the space between the connecting members radially outside of the second flexible sealing member is filled with leaking water, is capable of preventing deformation and damage of the elements of the flexible joint due to increase in the water pressure.

It is a third object of the invention to provide a flexible joint for a culvert capable of improving the efficiency of the secondary lining and reducing the required accuracy of the shield driving.

SUMMARY OF THE INVENTION

For achieving the first object of the invention, a flexible joint for a culvert according to the invention comprises a pair of annular connecting members, a flexible sealing member of a short cylindrical configuration made of rubber or a synthetic resin with end portions thereof being fixed to said connecting members, bearing means provided radially inwardly of said flexible sealing member with end portions thereof being fixed to said connecting members for supporting said flexible sealing member to prevent inward deformation of said flexible sealing member, said bearing means consisting of a plurality of bearing bars arranged circumferentially with a predetermined interval with end portions thereof being connected to said connecting members in a manner to be slidable in the axial direction within a predetermined range and to be prevented from disengaging from said connecting members, and cylinders fitted loosely on the outer periphery of said bearing bars and having an axial length which is smaller than a distance between the connecting members in an initial stage of installation.

According to the invention, by fitting cylinders having an axial length which is smaller than the distance between the connecting members in the initial stage of installation loosely on the bearing bars, the flexible sealing member will be supported by the cylinders and will not be clamped between the bearing bars and thereby damaged even if the flexible sealing membrer is deformed inwardly due to water pressure and, therefore, the number of the bearing bars can be held at the minimum which is sufficient for maintaining the minimum required strength for supporting the flexible sealing member and hence the flexible joint becomes lighter in weight and easier to hanle and assemble. Since the number of the bearing bars can be reduced, the manufacturing cost of the flexible joint will also be reduced.

For achieving the second object of the invention, the flexible joint having the above described structure further comprises an annular joint filling member provided between said connecting members for preventing flowing of concrete for a secondary lining into a space between said connecting members in which said flexible sealing member can stretch or contract and having a thickness in the radial direction which enables continuous depositing, along the inner surface thereof, of the concrete for the secondary lining from one culvert unit to another culvert unit to be joined together.

According to the invention, it becomes possible to deposit concrete for the second covering work continuously from one culvert unit to the other culvert unit along the inner surface of the joint filling material and, by cutting off a portion of the deposited concrete of a predetermined width between the connecting members, a gap is formed between the culvert units to be joined together and thus a flexible joint joining the two adjacnet culvert units is completed.

Accordingly, there is no projecting frame which will interfere with the operation of the slide form machine within the standard range of movement of a single operation of the slide form machine and, therefore, the operation of depositing concrete for the secondary lining is performed for each standard range of movement of the slide form machine without break whereby the secondary lining can be performed quite efficiently.

Moreover, allowance of variation in the radial position of the flexible joint caused by irregularity in the digging operation can be made larger than the value in the prior art flexible joint and hence a very high accuracy required in the prior art flexible joint is no longer required but a standard accuracy obtained in normal digging work is sufficient. Thus, the efficiency of the shield driving is improved.

Furthermore, since there is no interfering projecing frame as in the prior art flexible joint, movement of the slide form machine is facilitated.

For achieving the third object of the invention, a flexible joint further comprises a buffer material provided between the cylinders fitted on the bearing bars and the flexible sealing member which buffer material is compressed and deformed when it is subjected to water pressure exceeding a predetermined value.

According to the invention, by setting this predetermined value at a value of water pressure which is applied normally to the flexible sealing member by leaking water filled in the space between the connecting members, when an earthquake has occurred and the culvert units move toward each other and the water pressure has risen to exceed this predetermined value, the buffer material is compressed and deformed to produce a space which will receive the compressed water and thereby reduce the water pressure. Therefore, rise of the water pressure which will deform and damage the elements of the flexible joints including the bearing bars, cylinders and flexible sealing member can be effectively prevented.

For achieving the same object, the flexible joint further comprises cylindrical outer sleeves which have an axial length smaller than the distance between the connecting members in the initial state of installation and cover the cylinders loosely, said buffer material being filled annularly in a space between the outer peripheral surface of the cylinders and the inner peripheral surface of the outer sleeves along the entire circumference of the cylinders.

For achieving the same purpose, the flexible joint may comprise cylindrical inner sleeves fitted loosely on the outer periphery of the cylinders and having an axial length which is smaller than the distance between the connecting members in the initial stage of installation and cylindrical outer sleeves covering the outer periphery of the inner sleeves loosely and having an axial length which is smaller than the distance between the connecting, members in the initial stage of installation, said buffer material being filled in a space between the outer peripheral surface of the inner sleeves and the inner peripheral surface of the outer sleeves along the entire circumference of the inner sleeves.

For achieving the same purpose, the flexible joint may comprise a buffer material filling cylinders covering the cylinders loosely and having a distance between the inner side walls thereof which is slightly larger than the diameter of the cylinders and wherein said buffer material is filled in a space in the buffer material filling cylinders radially outside of the cylinders.

According to this aspect of the invention, the buffer material filling cylinders can slide in the radial direction along the outer peripheral surfaces of the cylinders or the bearing bars following deformation of the buffer material and restoration thereof to the original shape and hence the buffer material can be prevented from falling to the opposite space in the buffer material filling cylinders.

In another aspect of the invention, for achieving the first object of the invention, a flexible joint for a culvert comprises a pair of annular connecting members, a flexible sealing member of a short cylindrical configuration made of rubber or a synthetic resin with end portions thereof being fixed to said connecting members, bearing means provided radially inwardly of said flexible sealing member with end portions thereof being fixed to said connecting members for supporting said flexible sealing member to prevent inward deformation of said flexible sealing member, said bearing means consisting of a pair of support members of a short cylindrical configuration each having an annular connecting section, a cylindrical outer peripheral support section extending normally from the outer end portion of the connecting section for preventing inward deformation of the flexible sealing member, and a side wall section extending inwardly from the end portion of the outer peripheral support section opposite to the connecting section side, the end portions of the flexible sealing member being clamped between the connecting section of the support members and the connecting members by means of C-clamps.

According to this aspect of the invention, inward deformation of the flexible sealing member due to water pressure is sufficiently supported by the outer peripheral support section of the support members while the axial deformation of the flexible sealing member is supported by the side wall section of the support members whereby increase in excessive deformation and damage of the flexible sealing members can be prevented.

Besides, since the bearing means is of a simple structure consisting of a pair of cylindrical support members, the flexible joint becomes lighter in weight and easier to handle than the prior art flexible joint which employs a large number of bearing bars and so the manufacturing cost of the flexible joint can be reduced.

Besides, since the flexible sealing member is clamped in its end portions between the connecting members and the connecting section of the support members by means of the C-clamps without forming holes for inserting bolts, there is no problem of leakage of water through such holes for the bolts so that the sealing capacity of the joint is improved. In fixing the flexible sealing member, the difficult and time consuming work of aligning bolt holes in the flexible sealing member, connecting members and connecting section of the support members is not required and, therefore, mounting of the flexible sealing member is facilitated and the manufacturing cost of the joint can be reduced in this respect also.

In another aspect of the invention, for achieving the second object of the invention, a flexible joint further comprises an annular joint filling member provided between said connecting members for preventing flowing of concrete for a secondary lining into a space between said connecting members in which said flexible sealing member can stretch or contract and having a thickness in the radial direction which enables continuous depositing, along the inner surface thereof, of the concrete for the secondary lining from one culvert unit to another culvert unit to be joined together.

According to the invention, it becomes possible to deposit concrete for the secondary lining continuously from one culvert unit to the other culvert unit along the inner surface of the joint filling material and, by cutting off a portion of the deposited concrete of a predetermined width between the connecting members, a gap is formed between the culvert units to be joined together and thus a flexible joint joining the two adjacnet culvert units is completed.

Accordingly, there is no projecting frame which will interfere with the operation of the slide form machine within the standard range of movement of a single operation of the slide form machine and, therefore, the operation of depositing concrete for the secondary lining is performed for each standard range of movement of the slide form machine without break whereby the secondary lining can be performed quite efficiently.

Moreover, allowance of variation in the radial position of the flexible joint caused by irregularity in the digging operation can be made larger than the value in the prior art flexible joint and hence a very high accuracy required in the prior art flexible joint is no longer required but a standard accuracy obtained in normal digging work is sufficient. Thus, the efficiency of the shield driving is improved.

Furthermore, since there is no interfering projecing frame as in the prior art flexible joint, movement of the slide form machine is facilitated.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Referring first to FIGS. 1 to 4, an embodiment of the invention will be described.

Culvert units 1, 1' of a generally cylindrical configuration are made of primary linings 15, 15' each of which is constructed of segments such as steel segments, concrete segments or RC segments and secondary linings 16, 16' each of which is constructed by depositing concrete on the inner surface of the primary linings 15, 15'. The culvert units 1, 1' are joined together by a flexible joint A made according to the invention.

Figure 2:
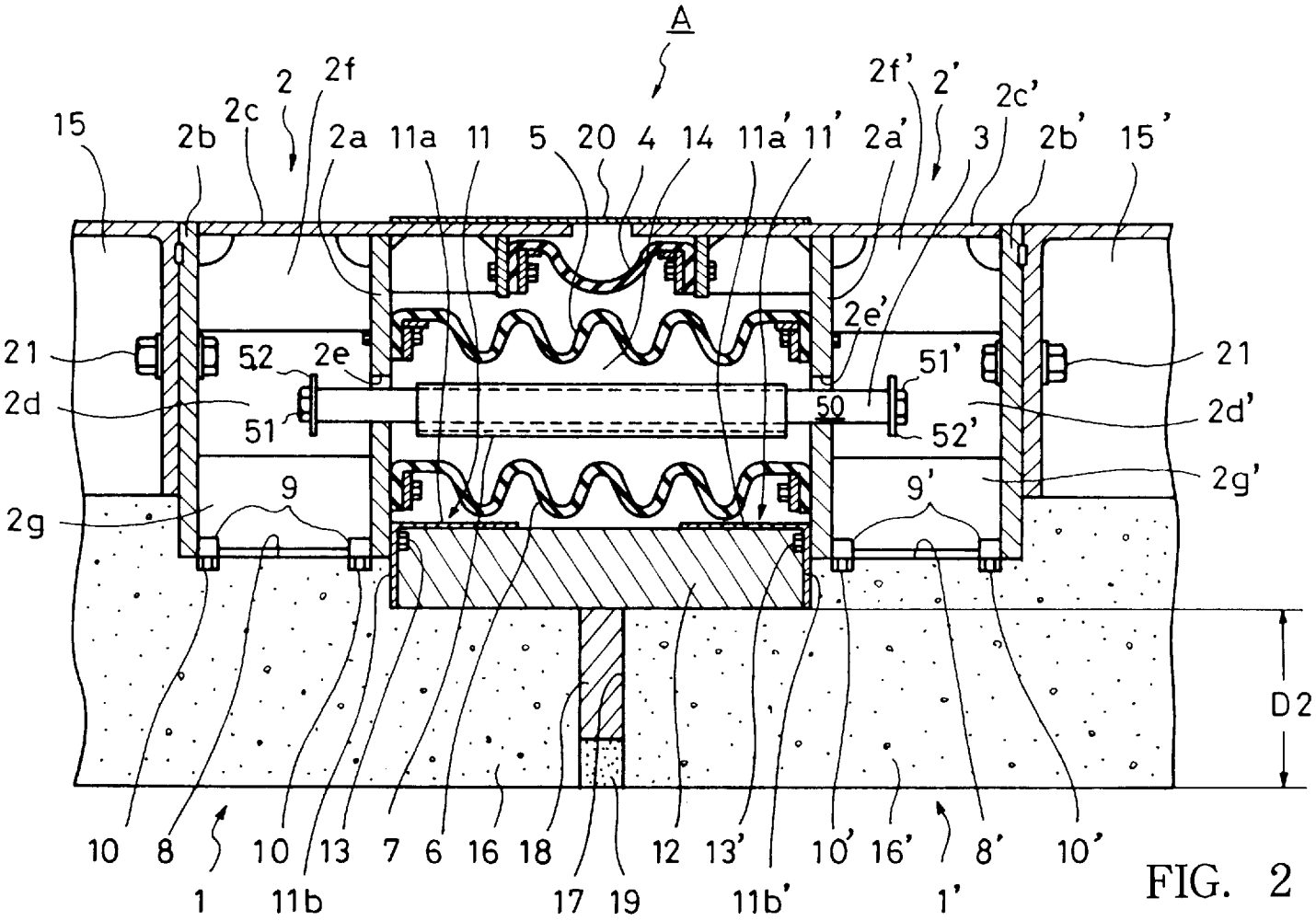
FIG. 2 is a sectional view showing the embodiment of the invention in its completed state.

The flexible joint A includes a pair of connecting members 2, 2' fixed to opposing surfaces of the culvert units 1, 1' as shown in FIG. 2. These connecting members 2, 2' are formed annularly in conformity with the end surfaces of the culvert units 1, 1'. The connecting members 2, 2' have box portions 2*c*, 2*c*'. The box portions 2*c*, 2*c*' have inner side walls 2*a*, 2*a*' opposing to each other and outer side walls 2*b*, 2*b*' provided opposite to the inner side walls 2*a*, 2*a*'. Connecting plates 8, 8' which restrict the interval between the inner side walls 2*a*, 2*a*' and the outer side walls 2*b*, 2*b*' have their end portions fixed to the inner side walls 2*a*, 2*a*' and the outer side walls 2*b*, 2*b*' by means of nuts 9 welded to the inner side walls 2*a*, 2*a*' and the outer side walls 2*b*, 2*b*' and bolts 10 screwed to the nuts 9. These connecting plates 8, 8' are provided at a certain interval in the circumferential direction. Spaces 2*d*, 2*d*' are defined between the inner side wall 2*a* and the outer side wall 2*b* and also between the inner side wall 2*a*' and the outer side wall 2*b*'. Openings 2*e*, 2*e* ' are formed in the inner side walls 2*a*, 2*a*' for inserting bearing bars 3 into the spaces 2*d*, 2*d*' and allowing axial sliding movement of the bearing bars 3 within a certain limited range within the spaces 2*d*, 2*d*' after insertion. Ribs 2*f*, 2*f*' and 2*g*, 2*g*' extending in the radial direction are provided at a certain interval in the circumferential direction.

Figure 1:
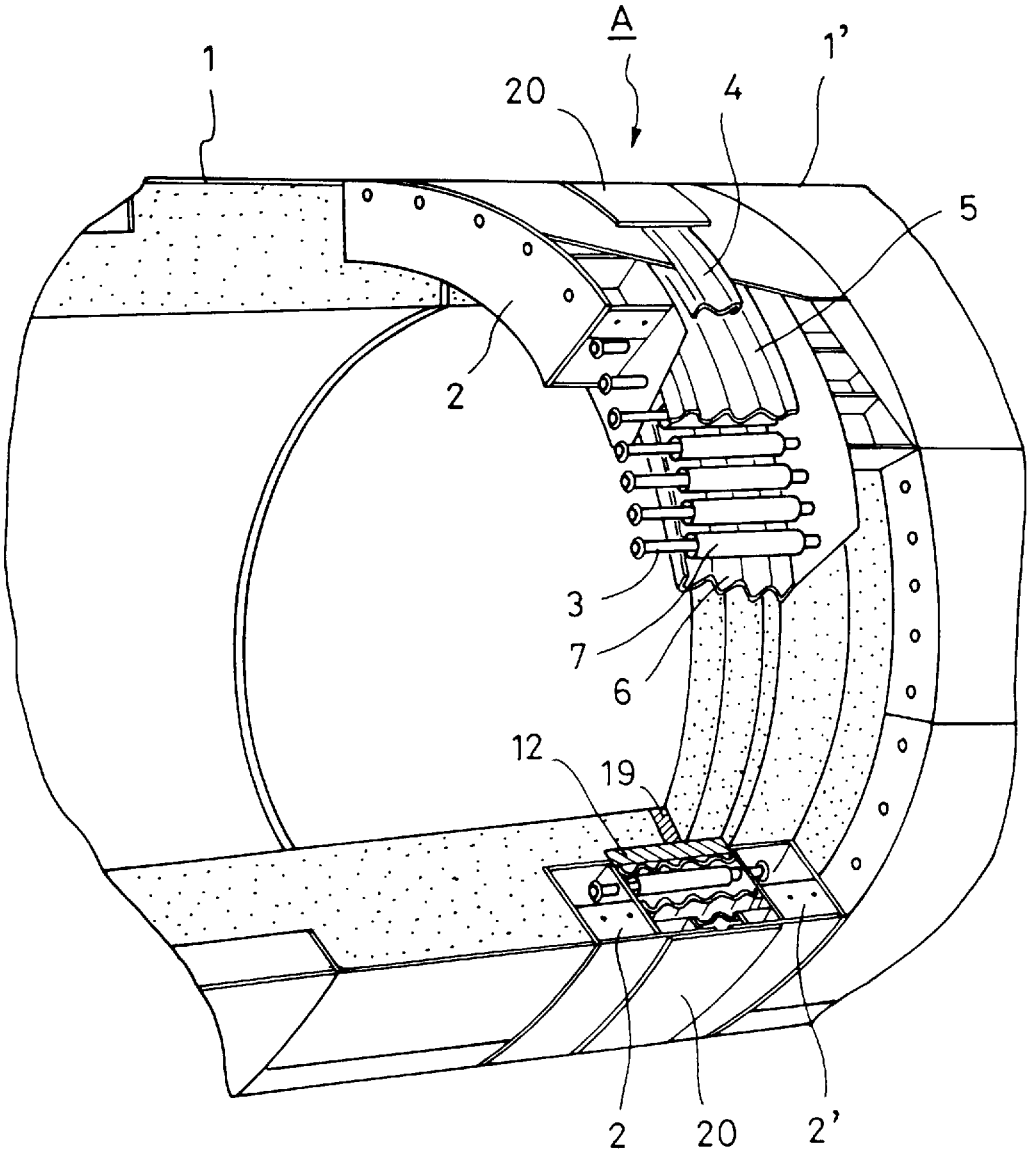
FIG. 1 is a perspective view, partly in section, showing a part of culvert units connected together by using an embodiment of a flexible joint according to the invention.
Figure 4:
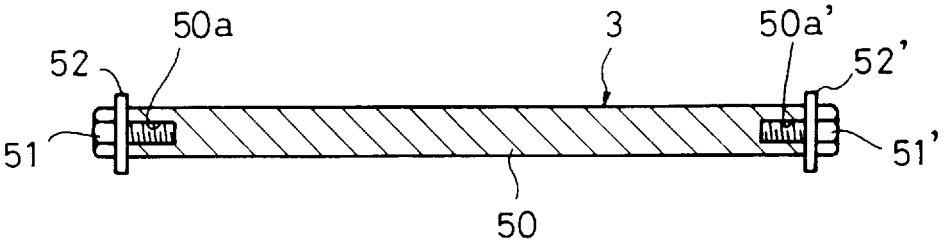
FIG. 4 is a sectional view showing an example of the bearing bar.

The bearing bars 3 provided between the connecting members 2, 2' are arranged, as shown in FIG. 1, with a certain equal interval in the circumferential direction along the connecting members 2, 2'. Each of these bearing bars 3 has, as shown in FIG. 4, a bar 50 which is inserted in the spaces 2*d*, 2*d*' through the openings 2*e*, 2*e*' of the connecting members 2, 2', threads 50*a*, 50*a*' at end portions of the bar 50, bolts 51, 51' which are in threaded engagement with the threads 50*a*, 50*a*' and washers 52, 52'. The washers 52, 52' are formed with a diameter larger than the diameter of the openings 2*e*, 2*e*' to prevent disengagement of the bar 50 from the openings 2*e*, 2*e*'. Thus, the bearing bars 3 are received at their end portions in the spaces 2*d*, 2*d*' in a manner to be prevented from being disengaged from the connecting mem-brers 2, 2'. By this structure, the bearing bars 3 connect the connecting members 2, 2' slidably relative to each other within a certain limited range.

The bars 50 of the bearing bars 3 are loosely covered by cylinders 7 having a larger diameter than the bars 50. The cylinders 7 have an axial length which is smaller by a predetermined value than the distance between the inner side walls 2*a*, 2*a*' of the connecting members 2, 2' in the initial stage of installation. The cylinders 7 are arranged circumferentially with the bearing bars 3.

Radially outwardly of these cylinders 7 and coaxially with the cylinders 7 are arranged first and second outer flexible sealing members 4 and 5 having different diameters from each other. Also, radially inwardly of these cylinders 7 and coaxially with the cylinders 7 is arranged an inner flexible sealing member 6. These flexible sealing members 4, 5 and 6 have a generally cylindrical configuration and undulating or arcuate surfaces and have their end portions secured fixedly to the inner side walls 2*a*, 2*a*' of the box portions 2*c*, 2*c*' to connect the connecting members 2, 2' hermetically to each other. An annular skin plate 20 is provided to cover an annular gap formed between the outer peripheral surfaces of the connecting portions 2, 2'. The skin plate 20 is welded at one end portion thereof to the outer peripheral surface of either of the connecting members 2, 2' and, at the other end thereof, is spot-welded to the outer peripheral surface of the other connecting member to disengage readily from the other connecting member in case of a change in the underground environment such as an earthquake.

A pair of joint filling member mounting plates 11, 11' of a generally L-shaped section are provided for holding a joint filling member 12. The joint filling member mounting plates 11, 11' have annular peripheral wall sections 11*a*, 11*a*' extending in the axial direction of the flexible joint A and side wall sections 11*b*, 11*b*' extending perpendicularly from the peripheral wall sections 11*a*, 11*a*'. The side wall sections 11*b*, 11*b*' are fixed to the radially inner end portions of the inner annular side walls 2*a*, 2*a*' of the connecting members 2, 2' by means of bolts 13, 13'.

The joint filling member 12 of a cylindrical configuration is disposed in the space defined by the pair of joint filling member mounting plates 11, 11' and secured to the peripheral wall sections 11*a*, 11*a*' and the side wall sections 11*b*, 11*b*' by a bonding agent. This joint filling member 12 functions to prevent, in carrying out the secondary lining, flowing of concrete for the secondary lining into a space 14 between the connecting members 2, 2' in which the flexible sealing members 5 and 6 can stretch and contract and also to prevent damage to the inner flexible sealing member 6 by operation of a cutter (not shown) for cutting off a part of deposited concrete for the secondary lining as will be described later. The joint filling member 12 has a thickness in the radial direction which enables continuous depositing, along the inner surface of the joint filling member 12, of the concrete for the secondary lining from one culvert unit to the other culvert unit to be joined together. As the joint filling member 12, materials such as foamed rubber, sponge and foamed polystyrol which are light in weight and have sufficient softness and elasticity are preferable.

The secondary linings 16, 16' which cover the primary linings 15, 15' have a gap 17 formed therebetween. In this gap 17 is filled a joint filling member 18 such as a foamed rubber and a fillig material 19 for providing a smooth inner peripheral surface which is flush with the inner peripheral surfaces of the culvert units 1, 1'.

For constructing the flexible joint A described above, the connecting members 2, 2', bearing bars 3, the first outer flexible sealing member 4, second outer flexible sealing member 5, inner flexible sealing member 6 and cylinders 7 are assembled together and the outer side walls 2*b*, 2*b*' of the connecting members 2, 2' of this assembled structure are attached, by means of bolts 21, to the end surfaces of the primary linings 15, 15' consisting of the segments of the culvert units 1, 1'.

Then, the joint filling member mounting plates 11, 11' are secured to the inner end portions of the inner side walls 2*a*, 2*a*' of the connecting members 2, 2' and the joint filling member 12 is fixed to the joint filling member mounting plates 11, 11' by means of a bonding agent.

Figure 3:
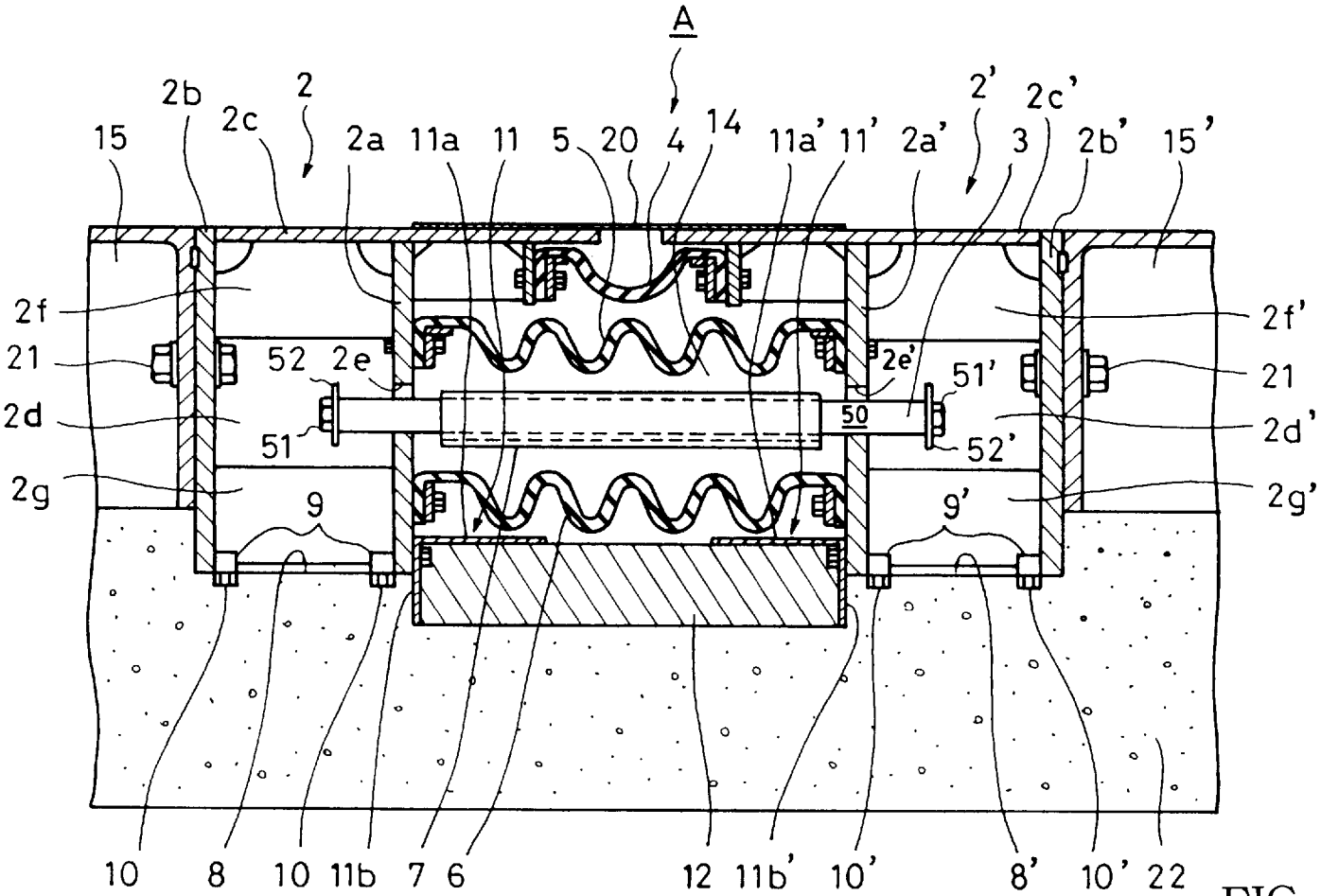
FIG. 3 is a sectional view showing the same embodiment in a state where depositing of concrete for a secondary lining has been completed.

Then, the slide form machine is used for depositing concrete 22 for the secondary lining continuously as shown in FIG. 3 along the inner surface of the joint filling member 12 from one of the culvert units 1, 1' to the other. Since there is no framework projecting to interfere with the progress of the slide form machine as in the prior art flexible joint, the slide form machine can deposit concrete sequentially by a standard distance of movement without being interrupted by the framework, so that depositing of concrete for the secondary lining can be efficiently carried out.

In the embodiment of the invention, there is an allowance of D2 (FIG. 2) for radial deviation of the flexible joint caused by irregularity in the digging work by the shield driving method. This allowance D2 is much larger than the allowance D1 in the prior art flexible joint.

After depositing the concrete 22 for the secondary lining along the entire circcumference of the inner peripheral surface of the flexible joint portion, a central portion of the deposited concrete 22 between the connecting members 2, 2' is cut off by a cutter (not shown) to form the gap 17. This gap 17 is necessary for allowing relative displacement between the culvert units 1, 1' in case of a change in the underground environment such as an earthquake.

Finally, the joint filling member 18 and the filling material 19 are filled in the gap 17 to complete the flexible joint A.

Figure 5:
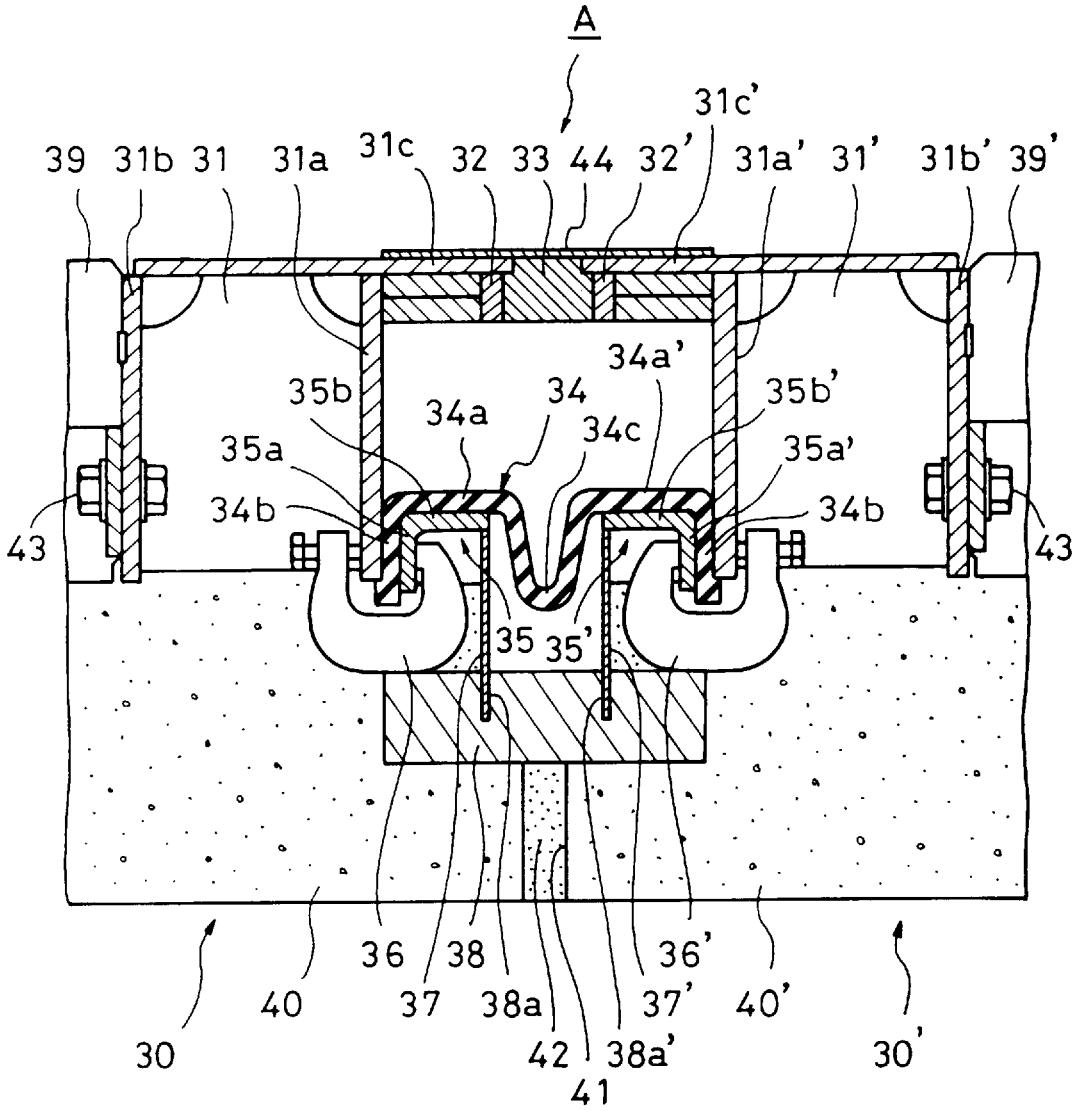
FIG. 5 is a sectional view showing another embodiment of the invention in its completed state.
Figure 6:
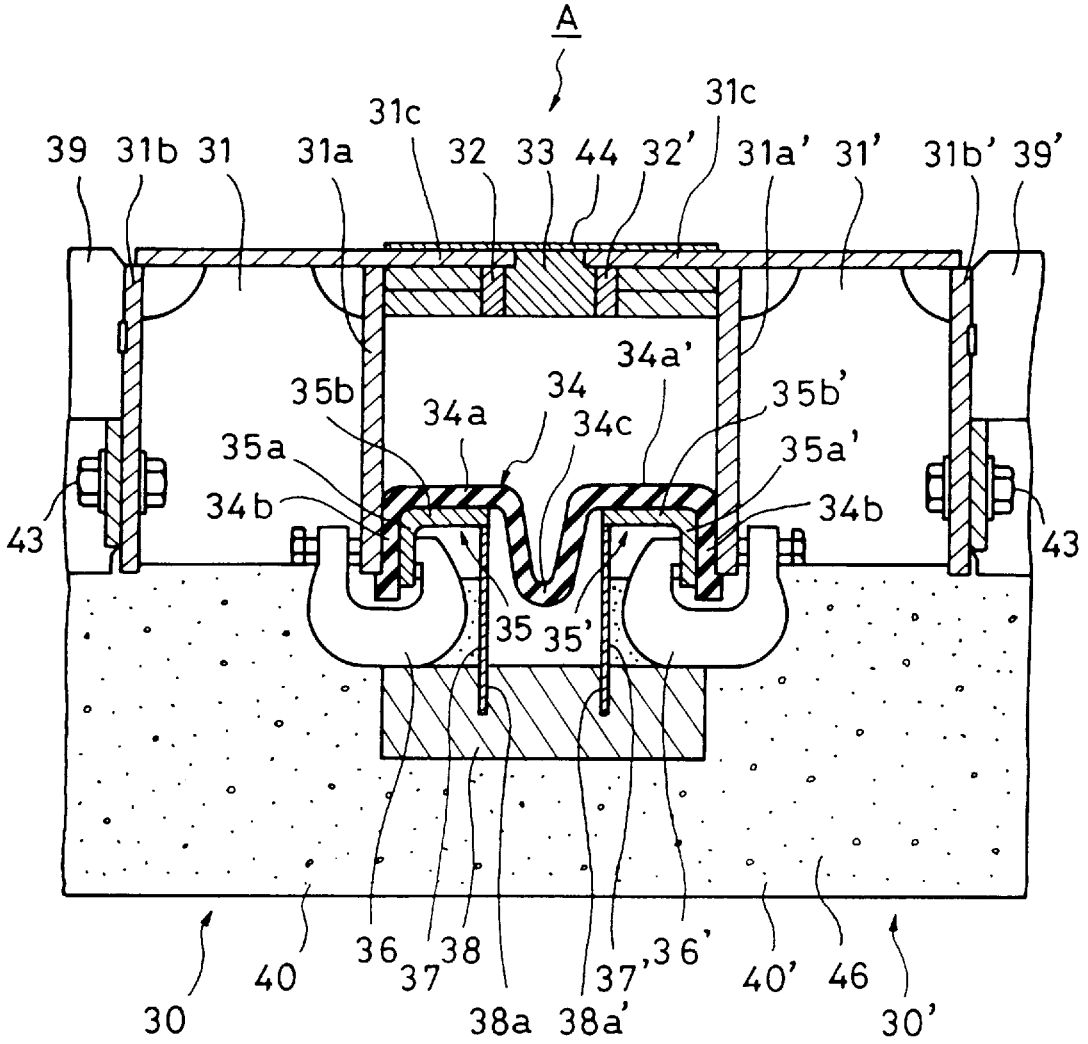
FIG. 6 is a sectional view showing the same embodiment in a state where depositing of concrete for a second covering work has been completed.

FIGS. 5 and 6 show another embodiment of the invention.

This flexible joint A includes a pair of annular connecting members 31, 31' fixed to the end surfaces of culvert units 30, 30' to be joined together. Annular sealing member holding plates 32, 32' are welded to outer peripheral portions 31*c*, 31*c*' of the connecting members 31, 31' and an annular sealing member 33 made of rubber or a synthetic resin is secured to the sealing member holding plates 32, 32'. A flexible sealing member 34 made of rubber or a synthetic resin is fixed to inner end portions of annular inner side walls 31*a*, 31*a*' of the connecting members 31, 31'.

A pair of support members 35, 35' of a short cylindrical configuration are disposed so as to abut against the inner surface of middle portion 34*a* of the flexible sealing member 34. The support members 35, 35' have annular connecting sections 35*a*, 35*a*' used for connecting the end portions of the flexible sealing member 34 to the connecting members 31, 31', cylindrical outer peripheral support sections 35*b*, 35*b*' extending normally from the outer end portions of the connecting sections 35*a*, 35*a*' for preventing inward deformation of the flexible sealing member 34, and side wall sections 37, 37' extending inwardly from the end portions of the outer peripheral support sections 35*b*, 35*b*' opposite to the connecting section side for preventing axial deformation of a stretchable portion 34*c* of the flexible sealing member 34 in a stretching direction due to water pressure.

The support members 35, 35' may be formed by integral annular members but may preferably be formed by several units which constitute an annular support member when assembled together for the convenience of assembling and transportation.

The end portions 34*b*, 34*b*' of the flexible sealing member 34 are held between the inner side walls 31*a*, 31*a*' of the connecting members 31, 31' and the connecting sections 35*a*, 35*a*' of the support members 35, 35' and clamped hermetically therebetween by means of C-clamp 36, 36'.

The joint filling member 38 has grooves 38*a*, 38*a*' to receive the end portions of the side wall sections 37, 37' of the support members 35, 35' and the end portions of the side wall sections 37, 37' are received in the grooves 38*a*, 38*a*' and bonded to the walls of the grooves 38*a*, 38*a*' by means of a bonding agent.

The joint filling member 38 has a structure and function similar to the joint filling member 12 of the embodiment of FIGS. 1 to 4 and a part of its outer peripheral surface is in contact with the inner side of the C-clamps 36, 36'.

Reference characters 39, 39' designate primary linings and 40, 40' secondary linings of the culvert units 30, 30'. A gap 41 is formed between the secondary linings 40, 40' and a filling material 42 is filled in this gap 41. A skin plate 44 having a structure similar to the skin plate 20 is provided on the outerperipheral surfaces 31*c*, 31*c*' of the connecting portions 31, 31'.

The above described flexible joint will be installed in the following manner:

First, the outer side walls 31*b*, 31*b*' of the connecting members 31, 31' and the other elements mounted on the connecting members 31, 31' except for the joint filling member 38 and filling material 42 are secured to the end surfaces of the primary linings 39, 39' of the culvert units 30, 30' consisting of the segments by means of bolts 43.

A bonding material is applied to the grooves 38*a* of the joint filling member 38 and the side wall sections 37, 37' of the support members 35, 35' are inserted into the grooves 38*a*, 38*a*' to fix the joint filling member 38 to the side wall sections 37, 37'.

Then, the slide form machine is operated to deposit the secondary lining concrete 46 along the inner peripheral surface of the flexible joint A as shown in FIG. 6 from one of the culvert units 30, 30' to the other.

After depositing the concrete 46, a portion of a predetermined width of the concrete 46 between the connecting members 31, 31' is cut off by means of a cutter (not shown) to form the gap 41 and the filling material 42 is filled in the gap 41 to complete the flexible joint A.

Since the flexible joint of this embodiment shown in FIGS. 5 and 6 has the above described structure, this flexible joint has the following advantages:

According to this embodiment in which the support members 35, 35' have outer peripheral support sections 35*b*, 35*b*' and the side wall sections 37, 37', inward deformation of the flexible sealing member 34 due to water pressure is sufficiently supported by the outer peripheral support section 35*b*, 35*b*' of the support members 35, 35' while the axial deformation of the flexible sealing member 34 is supported by the side wall section 37, 37' of the support members 35, 35' whereby increase in excessive deformation and damage of the flexible sealing members 34 can be prevented.

Besides, since the bearing means is of a simple structure consisting of a pair of cylindrical support members 35, 35', the flexible joint becomes lighter in weight and easier to handle than the prior art flexible joint which employs a large number of bearing bars c and so the manufacturing cost of the flexible joint can be reduced.

Besides, since the flexible sealing member 34 is clamped in its end portions between the connecting members 31, 31' and the connecting section 35*a*, 35*a*', of the support members 35, 35' by means of the C-clamps 36, 36' without forming holes for inserting bolts, there is no problem of leakage of water through such holes for the bolts so that the sealing capacity of the joint is improved. In fixing the flexible sealing member 34, the difficult and time consuming work of aligning bolt holes in the flexible sealing member 34, connecting members 31, 31' and connecting section 35*a*, 35*a*' of the support members 35, 35' is not required and, therefore, mounting of the flexible sealing member 34 is facilitated and the manufacturing cost of the joint can be reduced in this respect also.

Figure 7:
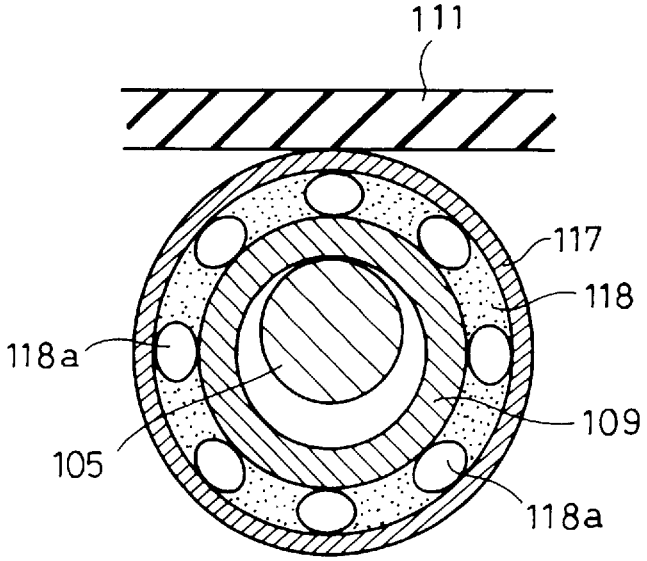
FIG. 7 is a sectional view taken along arrows 5—5 in FIG. 8 showing an essential portion of another embodiment of the invention.
Figure 8:
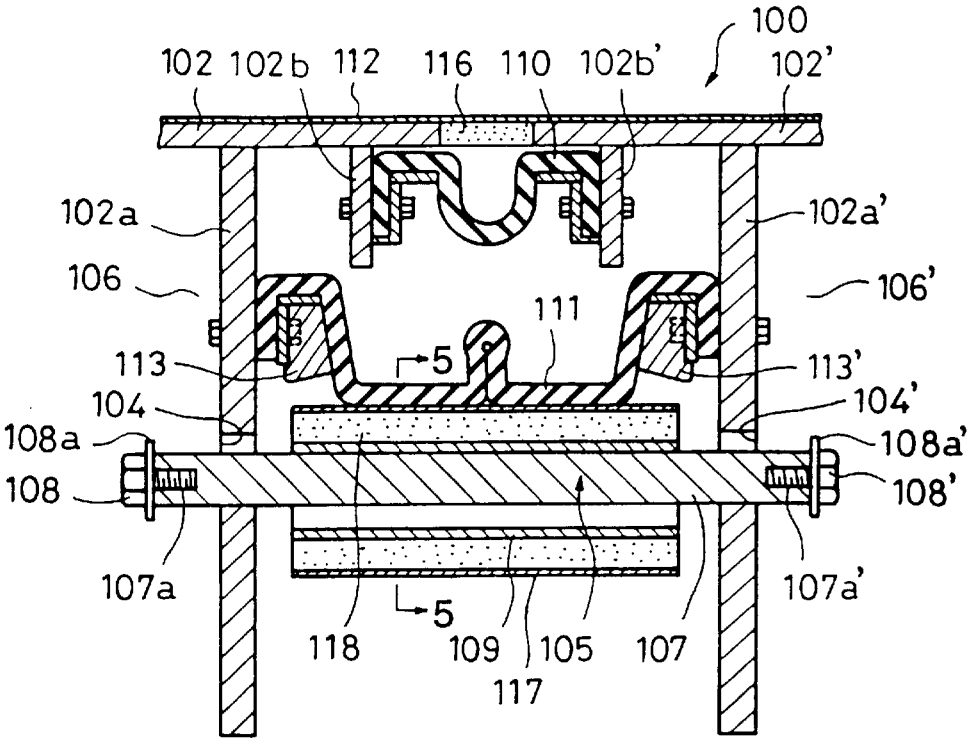
FIG. 8 is a sectional view showing the same embodiment in a normal state.
Figure 9:
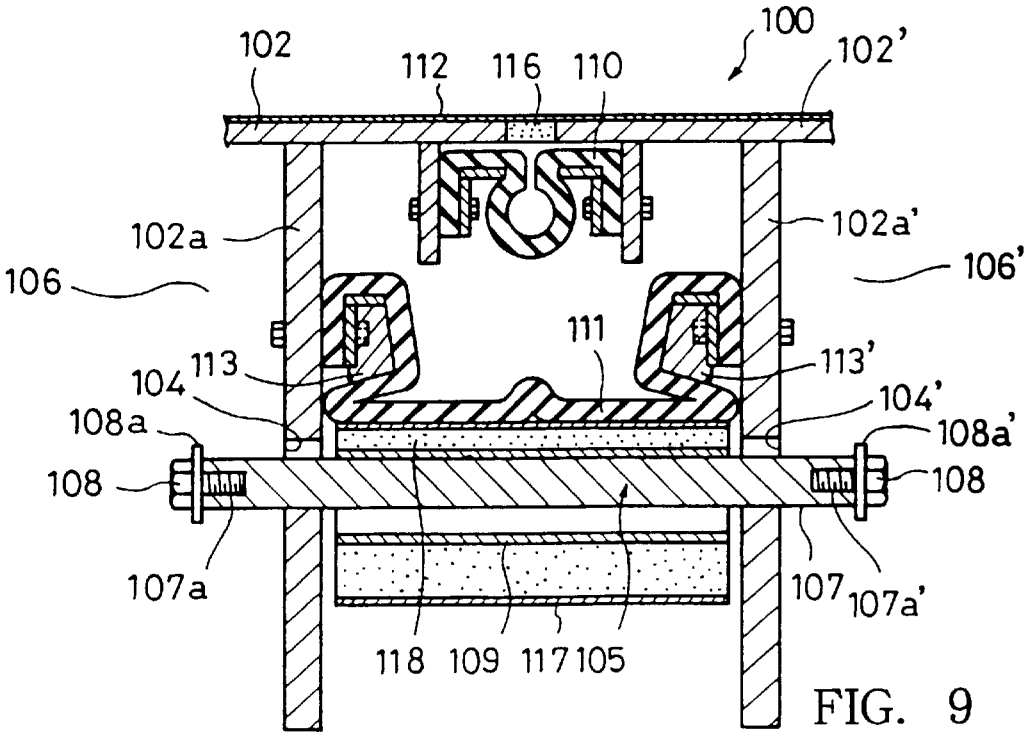
FIG. 9 is a sectional view showing the same embodiment in a state where two culvert units joined by the flexible joint have moved toward each other due to earthquake.
Figure 10:
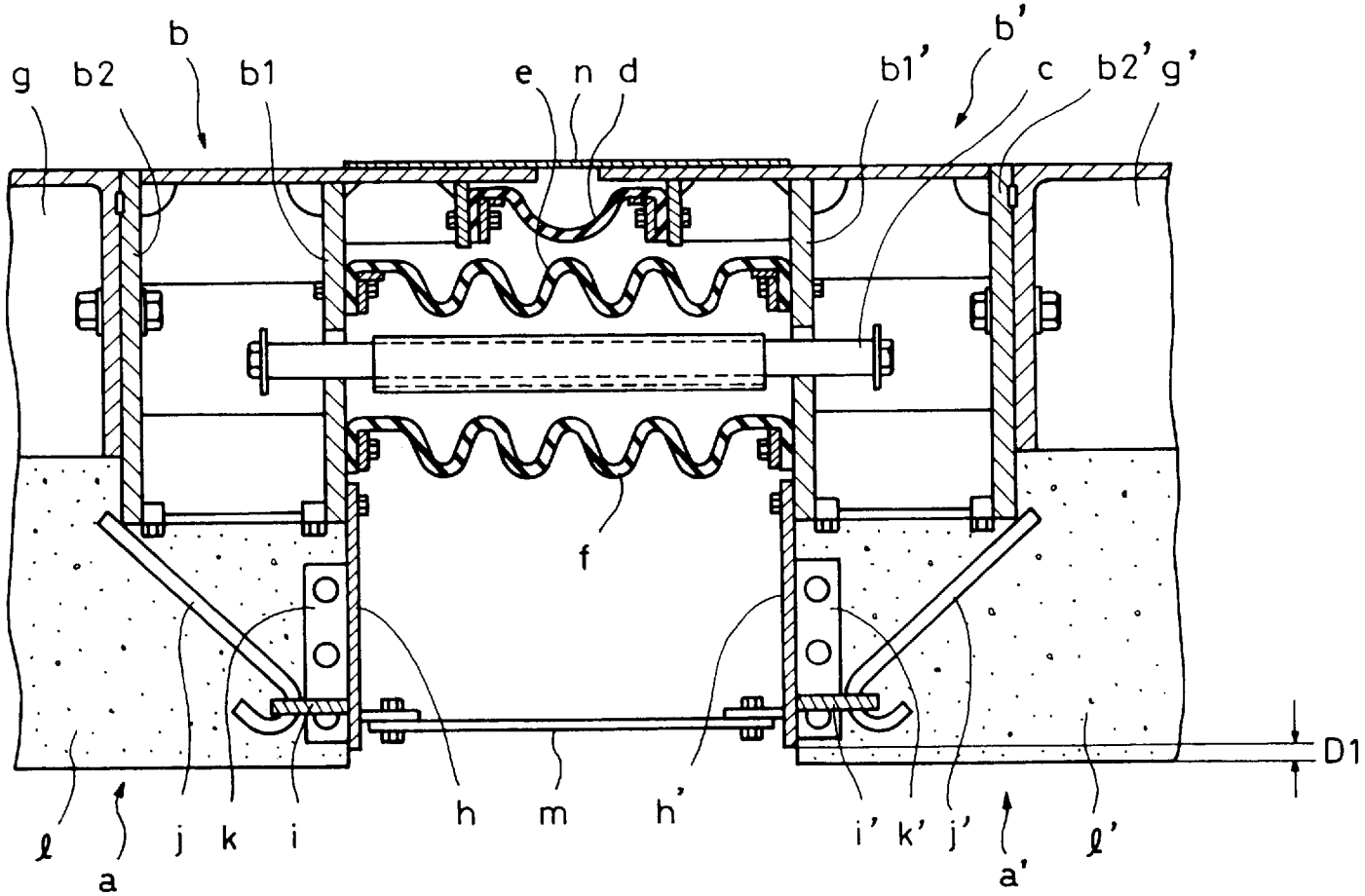
FIG. 10 is a sectional view showing a prior art flexible joint for a culvert.

Referring now to FIGS. 7 to 9, another embodiment of the invention will be described.

A flexible joint 100 has generally a structure similar to the flexible joint A of FIG. 1 having a cylindrical configuration connecting culvert units having a primary lining of segments and a secondary lining of concrete deposited on the segments. FIGS. 8 and 9 show only essential portions of the flexible joint of this embodiment.

The flexible joint 100 has a pair of connecting members 102, 102'. These connecting members 102, 102' are of a construction similar to the one shown in FIG. 1 and have a short cylindrical configuration. The outer side walls (not shown) of these connecting members 102, 102' are fixed to the end surfaces of culverts (not shown) to be joined together. Inner side walls 102*a*, 102*a*' of the connecting members 102, 102' are formed with openings 104, 104' for allowing axial displacement of bearing means 105 within a certain limited range after inserting the bearing means into spaces 106, 106' of the connecting members 102, 102'.

The bearing means 105 is provided between the inner side walls 102*a*, 102*a*' of the connecting members 102, 102'. In FIGS. 8 and 9, only one bearing means is shown but actually a plurality of bearing means 105 are circumferentially arranged at a certain equal interval along the inner side wails 102*a*, 102*a'*.

Each of the bearing means 105 has a bar 107 which is received at its end portions in the spaces 106, 106' of the connecting members 102, 102' through the opening 104, 104', threads 107*a*, 107*a*' formed at end portions of the bar 107, bolts 108, 108' threaded with the threads 107*a*, 107*a*' and washers 108*a*, 108*a'*.

The washers 108*a*, 108*a*' have a larger diameter which is larger than the diameter of the openings 104, 104' to prevent disengagement of the bar 107 from the openings 104, 104'. In this manner, the bearing means 5 is received in its end portions in the spaces 106, 106' so as to be axially slidable and to be prevented from disengaging from the spaces 106, 106' of the connecting members 102, 102'.

In this manner, the bearing means 105 connects the connecting members 102, 102' in a manner to allow relative movement of the connecting members 102, 102'.

Radially outwardly of these bearing means 105 and coaxially with the bearing means 105 are arranged first and second outer flexible sealing members 110 and 111 having different diameters from each other. These flexible sealing members 110 and 111 have a generally cylindrical configuration and undulating or arcuate surfaces and have their end portions secured fixedly to side walls 102*b*, 102*b*' and the inner side walls 102*a*, 102*a*' of the connecting members 102, 102' to connect the connecting members 102, 102' hermetically to each other. a pair of annular flexibl sealing member support members 113, 113' are provided at radially inside positions near the end portions' of the flexible sealing member 111 to hold the flexible sealing member 111 in an initially installed shape. An annular skin plate 112 is provided to cover an annular gap formed between the outer peripheral surfaces of the connecting portions 102, 102'. The skin plate 112 is welded at one end portion thereof to the outer peripheral surface of either of the connecting members 102, 102' and, at the other end thereof, is spot-welded to the outer peripheral surface of the other connecting member to disengage readily from the other connecting member in case of a change in the underground environment such as an earthquake.

On each bar 107 of the bearing means 105 is loosely fitted an inner sleeve 108 having an axial length smaller than the distance between the inner surfaces of the inner side walls 102*a*, 102*a*' of the connecting members 102, 102' in the initial stage of installation. On each inner sleeve 109 is loosely fitted an outer sleeve 117 having an axial length smaller than the distance between the inner surfaces of the inner side walls 102*a*, 102*a*' of the connecting members 102, 102' in the initial stage of installation. A buffer material 118 is filled in a space between the outer peripheral surface of the inner sleeve 109 and the inner peripheral surface of the outer sleeve 117 along the entire circumference of the inner sleeve 109.

As the buffer material 118, a material which is compressed and deformed by a relatively small amount under water pressure which is applied normally to the flexible sealing member 111 by water filled in space between the connecting members 102, 102' and is compressed and deformed by a relatively large amount when the water pressure has exceeded the value of water pressure at a normal time is desirable from the standpoint of obtaining a large amount of deformation in the event of an earthquake. As such material, foamed resin such as foamed styrol exhibits the largest amount of compression against increase in water pressure. Foamed rubber and buffer rubber which have a relatively small reaction force exhibit a relatively large amount of compression next to foamed resin. The foamed resin however has the problem that once it has been compressed and deformed under pressure it hardly is restored to the original shape so that it is not suitable for a repeated operation. In contrast thereto, rubber is restored to the original shape after being compressed when the water pressure drops to a normal value so that it can perform the compressing operation repeatedly in the event of an earthquake. From this standpoint, rubber is the most advantageous material as the buffer material 118.

In the present embodiment, rubber or foamed rubber is used as the buffer material 118 and, as shown in FIG. 7, voids 118*a* are formed in the buffer material 118 along the entire circumference to increase the amount of deformation of the buffer material 118. The type of the buffer material 118, shape of the voids 118*a* and the amount of buffer material 118 are determined having regard to the volume of space necessary for introducing water which space is formed by compression of the buffer material 118 when water pressure rises in the event of an earthquake.

In any case, it is necessary to determine a value of water pressure which exceeds a value of water pressure applied normally by water filled in the space between the connecting members 102, 102' and select a material, as the buffer material 118, which is substantially not deformed by this predetermined value of water pressure but is largely compressed and deformed when the water pressure has exceeded this predetermined value.

An annular spacer 116 made of foamed styrol is inserted in a gap between the connecting members 102, 102' for securing clearance and perform the function of a buffer material.

The operation of the flexible joint of this embodiment will now be described.

Normally, water presssure of leaking water filled in the space between the connecting members 102, 102' and outside of the flexible sealing member 111 is below the predetermined value at which substantial deformation due to compression of the flexible sealing member 111 starts and, therefore, no substantial deformation of the flexible sealing member 111 is produced and the flexible sealing member 111 is supported on the outer sleeves 117 as shown in FIG. 8.

When an earthquake has occurred and the culvert units move toward each other, the space outside of the flexible sealing member 111 between the inner side walls 102*a*, 102*a*' of the connecting members 102, 102' is reduced and, therefore, water filled in this space is compressed and the water pressure increases above the predetermined value. In this case, the buffer material 118 filled between the sleeves 109 and 117 is compressed and deformed as shown in FIG. 9 and thereby provides space for introducing compressed water and thereby prevents an excessive increase in the water pressure. The inner sleeve 109 and the outer sleeve 117 move radially inwardly as shown in FIG. 9. Air which was contained in the buffer material 118 escapes from both sides of the sleeves 109 and 117 into the flexible joint 100.

When the earthquake has ceased and the culvert units are restored to their original positions, the flexible sealing member 111 is restored to the original position on shown in FIG. 8. Since rubber or foamed rubber is used as the buffer material 118 in this embodiment, The buffer material 118 which has been compressed and deformed is restored to its original state. Accordingly, the sleeves 109 and 117 move radially outwardly to the original positions shown in FIG. 8.

Alternatively, the cylinders 7 of the bearing bar 3 as shown in FIG. 1 may be provided and the inner sleeves 109 and outer sleeves 117 as shown in FIG. 8 may be provided outside of the cylinders 7 and a buffer material may be filled in a space between the inner and outer sleeves 109 and 117.

Alternatively, the outer sleeve may be formed in the form of a rectangular cylinder having a distance between the inner side walls thereof which is slightly larger than the outer diameter of the inner sleeve 119 and a buffer material may be filled in a space in the outer sleeve radially outside of the inner sleeve 109. In this case, the outer sleeve can slide in the radial direction along the outer peripheral surface of the inner sleeve 109 following deformation of the buffer material and restoration thereof to the original shape.

The present invention is applicable not only to the culvert having the primary lining of segments and the secondary lining of deposited concrete as in the above described embodiments but to culverts using other materials. The invention is applicable not only to a culvert of a circular cross section but to culverts of other cross sections such as rectangular, oval and polygonal cross sections. The flexible sealing members may have other shapes than those illustrated in accompanying drawings.

What is claimed is:

1. A flexible joint for a culvert comprising:

a pair of annular connecting members;

a flexible sealing member of a short cylindrical configuration made of rubber or synthetic resin with end portions thereof being fixed to said connecting members;

bearing means provided radially inwardly of said flexible sealing member with end portions thereof being fixed to said connecting members for supporting said flexible sealing member, said bearing means consisting of a plurality of bearing bars arranged circumferentially with a predetermined interval with end portions thereof being connected to said connecting members in a manner to be slidable in the axial direction within a predetermined range and to be prevented from disengaging from said connecting members;

cylinders fitted loosely on the outer periphery of said bearing bars and having an axial length which is smaller than a distance between the connecting members in an initial stage of installation;

an annular joint filling member provided between said connecting members and between said bearing means and secondary linings of said culvert for preventing flowing of concrete for said secondary linings into a space between said connecting members in which said flexible sealing member can stretch or contract, said joint filling member having a thickness in the radial direction which enables continuous depositing, along the inner surface thereof, of concrete for the secondary linings from one culvert unit to another culvert unit to be joined together in installation and, after installation, the inner surface of said joint filling member being in contact with the outer surface of said secondary linings said flexible joint further comprising, cylindrical outer sleeves which have an axial length smaller than the distance between the connecting members in the initial state of installation and cover the cylinders loosely, a buffer material being filled annularly in a space between the outer peripheral surface of the cylinders and the inner peripheral surface of the outer sleeves along the entire circumference of the cylinders.

2. A flexible joint as defined in claim 1 wherein said buffer material is formed with voids along the entire circumference.

* * * * *